United States Patent [19]

Grecksch et al.

[11] Patent Number: 5,035,371

[45] Date of Patent: Jul. 30, 1991

[54] APPARATUS FOR STABILIZING A YARN PACKAGE TUBE DURING YARN UNWINDING

[75] Inventors: Hans Grecksch; Dietmar Engelhardt, both of Monchengladbach, Fed. Rep. of Germany

[73] Assignee: W. Schlafhorst & Co., Moenchengladbach, Fed. Rep. of Germany

[21] Appl. No.: 456,384

[22] Filed: Dec. 26, 1989

[30] Foreign Application Priority Data

Dec. 23, 1988 [DE] Fed. Rep. of Germany ..... 3843553

[51] Int. Cl.[5] ..... B65H 54/20; B65H 67/02

[52] U.S. Cl. ..... 242/35.5 R; 242/35.5 A

[58] Field of Search ..... 242/35.5 R, 35.5 A; 57/274, 281

[56] References Cited

U.S. PATENT DOCUMENTS

| | | | |
|---|---|---|---|
| 3,382,659 | 5/1968 | Schulz et al. | 57/281 |
| 4,597,540 | 7/1986 | Kiriake | 242/35.5 A |
| 4,630,435 | 12/1986 | Igel | 57/281 |
| 4,953,798 | 9/1990 | Tone et al. | 242/35.5 R |

*Primary Examiner*—Stanley N. Gilreath

*Attorney, Agent, or Firm*—Shefte, Pinckney & Sawyer

[57] ABSTRACT

A tube stabilizing apparatus is provided for a textile machine of the type having a plurality of independently movable tube support members, an unwinding device for unwinding textile packages and various transporting assemblies for transporting tube support members to and from the unwinding device. The unwinding device is provided with a yarn end loosening apparatus having a pair of independently movable chamber portions, the pair of chamber portions forming a gas guide chamber for encircling a yarn package during loosening of the yarn end from the yarn package. The gas guide chamber is formed with a lateral opening. The tube stabilizing apparatus includes an arm member and a member for selectively moving the arm member through the lateral opening of the gas guide chamber into contact with the tube of a yarn package to thereby apply force against the tube in a lateral direction toward an opposing member. The arm member and the opposing member stabilize the tube to minimize lateral movement of the tube.

7 Claims, 7 Drawing Sheets

APPARATUS FOR STABILIZING A YARN PACKAGE TUBE DURING YARN UNWINDING

BACKGROUND OF THE INVENTION

The present invention relates to an apparatus for stabilizing a yarn package tube during yarn unwinding and, more specifically, an apparatus for stabilizing a yarn package tube supported on an upright member during yarn unwinding.

In a textile winding operation, a yarn package comprising yarn wound on a cylindrical tube is disposed at an unwinding location for unwinding of the yarn from the yarn package and winding of the unwound yarn onto another yarn package. A yarn end, which may be already disposed in a preferred preliminary disposition or disposed at some random location relative to the yarn package, is loosened, if necessary, and engaged by a yarn engagement device which feeds the yarn end to a splicing device or other yarn feeding device for winding the yarn onto the other package. One known yarn package transport assembly for transporting yarn packages to the unwinding location includes individual tube support members each having an upright component compatibly configured with the inner diameter of a cylindrical tube for snugly receiving a tube inserted thereon. The tube, and the yarn built thereon, is then supported in an upright disposition for transport to, at and from the unwinding location.

During the unwinding operation, the yarn is typically drawn off the yarn package in an upward direction at a relatively high rate. Accordingly, it is desirable to maintain the tube, and the yarn wound thereon, in a relatively stable disposition during the drawing off of the yarn to minimize the occurrence of undesirable wobbling or tilting action of the yarn package during the unwinding process. While it is possible to compatibly configure the upright component and the cylindrical tube such that the tube is received relatively snugly on the upright component, practical difficulties arise in maintaining the close tolerances.

The need therefore exists for a device for reliably stabilizing a tube during unwinding of yarn built thereon.

SUMMARY OF THE INVENTION

The present invention provides an apparatus for stabilizing the tube of a yarn package which is supported at the unwinding location of a textile winding machine. The apparatus acts to minimize lateral movement of the tube during unwinding of yarn therefrom so as to thereby minimize the occurrence of undesirable wobbling or tilting action of the yarn package during the unwinding process.

The present invention provides a tube stabilizing apparatus for a textile winding machine of the type having a plurality of independently movable tube support members for individually supporting tubes in generally upright dispositions. The textile winding machine typically includes an unwinding device for unwinding, at an unwinding location, packages of textile material such as yarn or the like which is wound on tubes supported on the tube support members. Additionally, the textile winding machine includes a delivery assembly for delivering the tube support members to a preliminary location for feeding to the unwinding device as well as a discharge assembly for transporting tube support members from a discharge location to a further handling location. The textile winding machine is also provided with a cross-transport assembly for transporting the tube support members along a cross path extending from the preliminary location through the unwinding location to the discharge location.

According to one aspect of the present invention, the tube stabilizing apparatus provided for a textile winding machine having the features as described above is specifically adapted for use with a textile winding machine which additionally includes a yarn end loosening apparatus of the type having a pair of independently movable chamber portions. The chamber portions are pivotally mounted by a pivot member adjacent to the cross path and means for pivoting each chamber portion between a clearance position in which the chamber portion is clear of the cross path for travel of a tube support member therepast and a chamber forming position in which the chamber portions are disposed in contact with one another to form a gas guide chamber for encircling a yarn package at the unwinding location. Each chamber portion has a lateral opening. In this one aspect of the present invention, the tube stabilizing apparatus includes means for engaging the tube of a supported package during unwinding of textile material from the package to prevent movement of the package during unwinding.

The tube engaging means preferably includes an arm member, a member opposing the arm member, and means for selectively moving the arm member relative to the gas guide chamber. The arm member selectively moving means moves the arm member through the lateral opening of the gas guide chamber into contact with the tube of a yarn package at the unwinding location to thereby apply a force against the tube in a lateral direction toward the opposing member. The opposing member engages a selected one of the tube and the tube support member opposite the lateral direction for stabilizing the tube between the arm member and the opposed member to thereby minimize lateral movement of the tube.

According to further features of the one aspect of the present invention, the opposing member is fixedly mounted to one of the chamber portions and is located generally at the level of the tube support member. The opposing member engages the tube support member when the one chamber portion is disposed in the chamber forming disposition.

According to yet another feature of the one aspect of the present invention, the lateral opening of the gas guide chamber is open toward the bottom of the chamber and the bottom portion of the tube is free of yarn. In this further feature, the arm member is moved relatively through the lateral opening of the gas guide chamber generally at the level of the bottom portion of the tube for engagement thereof.

According to another aspect of the present invention, the tube stabilizing apparatus is specifically adapted for use with the textile machine which includes a yarn end loosening apparatus having a pair of independently movable chamber portions which are pivotally mounted by a pivot member adjacent the cross path and means for pivoting each chamber portion between a clearance position and a chamber forming position. Additionally, each chamber portion has a lateral opening. In this other aspect of the present invention, the tube stabilizing apparatus includes means for engaging the tube of a supported package during unwinding of textile material from the package to prevent movement of the package during unwinding. The tube engaging means preferably includes first and second arm members, each having an arcuate portion forming a free end, and means for moving the arm members relative to the gas guide chamber. The means for relatively moving the arm members moves the arm members between an engaged position in which the free ends of the arm members are disposed opposite one another to compressively grip the tube therebetween. Each arcuate portion and a respective one of the chamber portions pivots about a common pivot point and each arcuate portion moves through the lateral opening of a respective one of the chamber portions during relative movement between the chamber portions.

According to one feature of the other aspect of the present invention, the tube stabilizing apparatus includes means interconnecting the arm members for synchronous tube engaging movement.

DETAILED DESCRIPTION OF THE PREFERRED EMBODIMENTS

Figure 1:
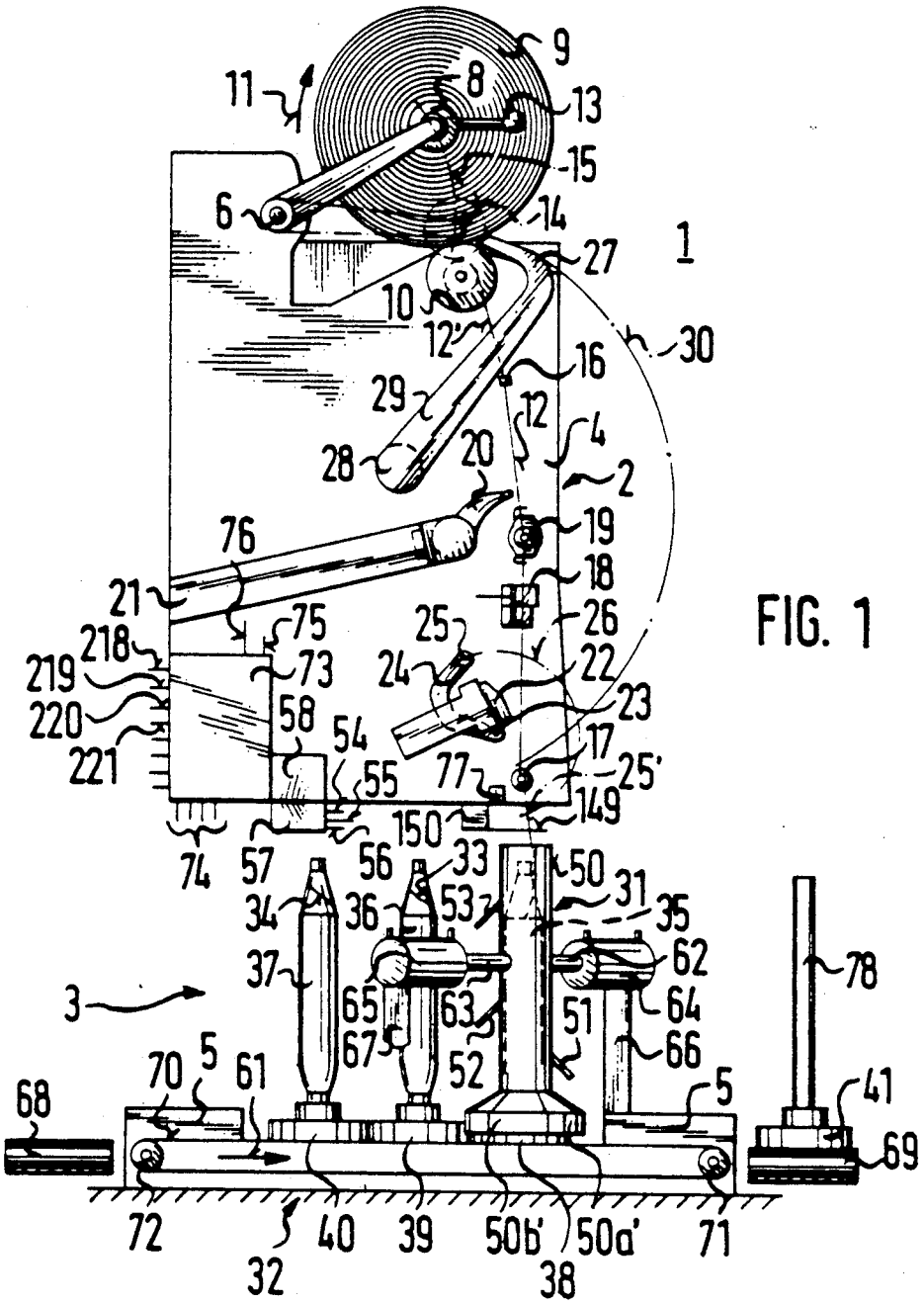
FIG. 1 is a side elevational view of a conventional winding station of a textile machine and a yarn package support apparatus for supporting a yarn package during the unwinding of yarn therefrom.

In FIG. 1, a conventional textile winding machine 1 having a winding station 2 mounted on a frame 4 and a conventional yarn package transport assembly 3 for transporting yarn packages to the winding station 2 for unwinding thereat are illustrated. The winding station 2 includes a yarn package support member 31 for supporting a yarn package during unwinding of yarn therefrom at an unwinding location.

In FIG. 1, a winding station 2 of a winding machine is seen to include a rocking shaft 6 of a creel 8 mounted on a machine frame 4 and carrying the tube of a crosswound bobbin 9. The bobbin 9 is in contact with a yarn guide drum 10 and is driven by the yarn guide drum 10 by means of friction in the direction indicated by the arrow 11. The yarn guide drum 10 is provided with reversing thread grooves for guiding a yarn 12 from a package being unwound at the unwinding location onto the bobbin 9 as a crosswound bobbin. The creel 8 is raised by a handle 13 to lift the bobbin 9 off the yarn guide drum 10.

At the start of winding, an empty tube 14 is clamped into the creel 8, as is shown in FIG. 1 in dotted lines. As the bobbin 9 is built, the creel 8 pivots upward along a circular arc 15.

The yarn 12 is supplied to the yarn guide drum 10 through a yarn eyelet 16. Yarn 12 traverses along a path 12' as it travels between the yarn eyelet 16 and the yarn guide drum 10.

As it comes from the yarn supply unit 3, yarn 12 runs through a conventional yarn tensioner 17, a conventional clearer 18 and a conventional waxing device 19 before it reaches yarn eyelet 16. In the event of a yarn break, the yarn can be drawn into a suction nozzle 20 which is connected to a conventional suction source 21.

To restore a yarn connection after a yarn break, a conventional splicing device 22 is located to the side of the yarn or thread course between the yarn tensioner 17 and the clearer 18. This splicing device 22 operates automatically in a conventional manner.

After a yarn break, the incoming yarn end is usually still present under the yarn tensioner 17. It is caught there for the purpose of splicing by a conventional yarn receiving element in the shape of a suction tube 24 which can pivot about a pivot 23 and whose suction intake mouth 25 is pivoted along circular arc 26 below the yarn tensioner 17 and back again into the initial position.

The upper yarn end has usually been wound onto the winding bobbin 9 after a yarn break. It is drawn in by suction by a suction intake nozzle 27 of a suction tube 29, which pivots about a pivot point 28. When the suction tube 29 is pivoted downward, the suction intake nozzle 27 moves with the attracted upper yarn along a circular arc 30. The entrained yarn is threaded thereby into the reversing thread groove of the yarn guide drum 10, the yarn eyelet 16, the waxing device 19 and the measuring slot of the clearer 18. It is also grasped by a conventional grasping means (not shown) of the splicing device 22 adjacent the lower yarn held by the suction intake mouth 25 of the suction tube 24. Immediately after restoration of the splicing connection, the splicing device 22 frees the yarn for resumption of the winding operation.

The winding station 2 includes a plurality of independently movable tube support members 38,39 and 40 for individually supporting a plurality of yarn packages 35,36 and 37, respectively, which comprise yarn built on an individual tube. Each yarn package 35–37 includes an upper reserve winding such as, for example, the upper reserve windings 33 and 34 on the yarn packages 36 and 37, respectively. As seen in FIG. 1, each tube support member 38,39,40, such as, for example, the tube support member 38, includes a cylindrical base plate 42, a top cylindrical plate 43 and a cylindrical upright component 45. The plates 42 and 43 and the upright cylindrical component 45 being coaxial. The upright component 45 has an outer diameter compatibly configured with respect to the inner diameter of the tubes onto which the yarn of the yarn packages 35–37 is built. Accordingly, the tube support members 38–40 individually support the yarn packages 35-37 in an upright disposition.

As seen in FIG. 1, the winding station 2 includes a conventional delivery assembly 68 having an endless belt for delivering the tube support members 38–40 to a preliminary location, a conventional discharge assembly 69 having an endless belt for transporting the tube support members 38–40 from a discharge location to a further handling location (not shown) and a cross-transport assembly 32 for transporting the tube support members 38–40 along a cross path extending from the preliminary location through an unwinding location to the discharge location. The cross-transport assembly 32 transports the tube support members 38–40, with the yarn packages 35–37 supported in upright dispositions thereon, to the unwinding location for individual unwinding of the yarn packages at the winding station 2.

The cross-transport assembly 32 includes an endless belt 70 trained around a pair of guide rollers 71,72 and driven by a conventional endless belt drive motor (not shown) in the direction indicated by the arrow 61 in FIG. 1. The junction of the delivery assembly 68 and the cross-transport assembly 32 defines the preliminary location. The tube support members 38–40 are transferred from the endless belt of the delivery assembly 68 to the endless belt 70 of the cross-transport assembly 32, at the preliminary location, in conventional manner. The junction of the endless belt of the discharge assembly 69 and the endless belt 70 of the cross-transport assembly 32 defines the discharge location. The tube support members 38–40 are transferred from the endless belt 70 of the cross-transport assembly 32 to the endless belt of the discharge assembly 69, at the discharge location, in conventional manner.

As seen in FIG. 1, the yarn end loosening apparatus 31 includes a support frame 5, a first support post 66 extending vertically from the support frame 5 and supporting a first movement means 64, a connector 62 and a first chamber portion 50*a* and a second support post 67 supporting a second movement means 65, a second connector 63 and a second chamber portion 50*b*. The first chamber portion 50*a* and the second chamber portion 50*b* form a gas guide chamber 50 when they are in mating contact with one another. The first movement means 64 and the second movement means 65 are each configured as a conventional hydraulic cylinder actuable to selectively retract and extend the respective associated connector 62 or 63, which are each configured as conventional hydraulic cylinder rods. The first movement means 64 and the second movement means 65 are each operatively connected by a plurality of conventional connectors 74 to a conventional central control unit 73 mounted to the winding station 2. The connectors 74 can be, for example, flexible pneumatic conduits.

The first chamber portion 50*a* is fixedly connected to the free end of the connector 62. The second chamber portion 50*b* is fixedly connected to the free end of the connector 63. As seen in FIG. 1, the first chamber portion 50*a* and the second chamber portion 50*b* support a plurality of jet nozzles 51,52 and 53 which are operatively connected by a plurality of flexible conduits 54,55 and 56, respectively, to a conventional regulating valve 57. The regulating valve 57 regulates the outflow of compressed gas from a conventional compressed gas source 58 operatively connected to the central control unit 73. The jet nozzles 51,52 and 53 direct jet streams of gas, which are supplied via the conduits 54,55 and 56 from the compressed gas source 58, against a yarn package positioned between the first chamber portion 50*a* and the second chamber portion 50*b* to loosen a yarn end on the yarn package, as described in more detail below.

Figure 6:
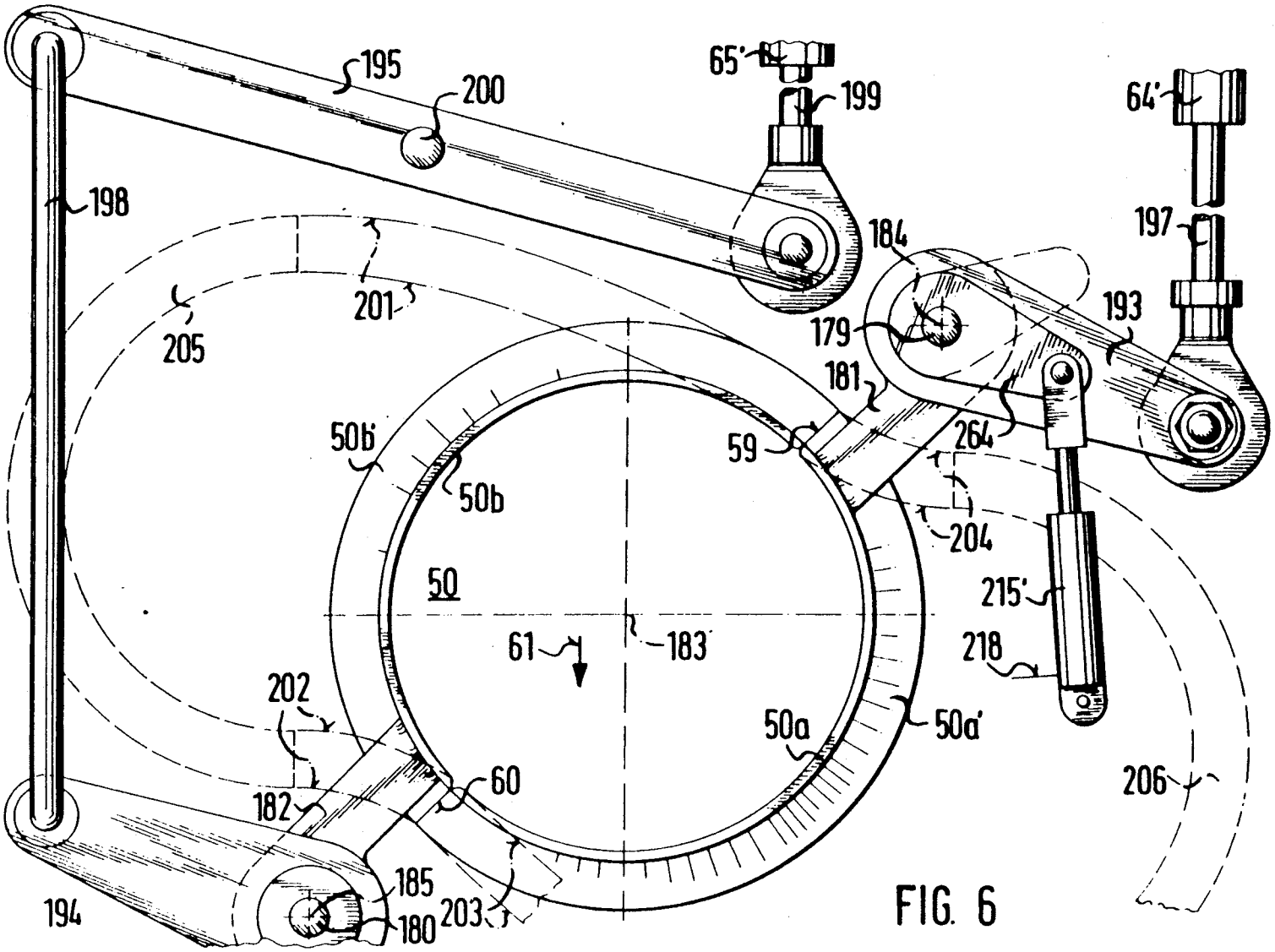
FIG. 6 is a plan view of the yarn package support apparatus shown in FIG. 1.

As seen in FIG. 6, the first chamber portion 50*a* and the second chamber portion 50*b* are respectively movable to a chamber forming position in which they define the gas guide chamber 50. In this regard, as seen in FIG. 1, the first chamber portion 50*a* includes a semi-cylindrical body portion having an axial extent greater than the length of any of the tubes supported on the tube support members 38,39,40 and an enlarged foot portion 50*a'* having a radial extent greater than the radial extent of the semicylindrical body portion. As seen in FIG. 1, the enlarged foot portion 50*a'* has a radial extent sufficient to accommodate the base plate 42 and the top plate 43 of a respective one of the tube support members 38,39,40 when the tube support member is positioned between the first chamber portion 50*a* and the second chamber portion 50*b* in the gas guide chamber 50.

The second chamber portion 50*b* includes a semicylindrical body portion and, as shown in FIG. 1, an enlarged foot portion 50*b'* having a radial extent greater than the radial extent of the semi-cylindrical portion. The radial extent of the enlarged foot portion 50*b'* is sufficient to accommodate the base plate 42 and the top plate 43 of a respective one of the tube support members 38,39,40 when the respective tube support member is positioned in the gas guide chamber 50.

The first chamber portion 50*a* and the second chamber portion 50*b* are compatibly configured with their respective semicylindrical body portions having the same radius and their respective enlarged foot portions 50*a'* and 50*b'* having the same cross sectional radial extent, such that the semi-cylindrical body portions and the enlarged foot portions, respectively, mate with one another along a first interface line 59 and a second interface line 60, as seen in FIG. 6, when the first chamber portion 50*a* and the second chamber portion 50*b* are moved into the chamber forming position to form the gas guide chamber 50. As seen in FIG. 1, the free end of the connector 62 is fixedly connected to the semicylindrical body portion of the first chamber portion 50*a* and the connector 63 is fixedly connected to the semi-cylindrical body portion of the second chamber portion 50*b* such that the semicylindrical body portions are supported in a vertical disposition. Thus, the gas guide chamber 50 includes a cylindrical portion, formed by the semi-cylindrical portions of the chamber portions 50*a*,50*b*, having an axis 183 (FIG. 6) As seen in FIG. 6, the first chamber portion 50*a* and the second chamber portion 50*b* are oriented relative to one another such that the first interface line 59 and the second interface line 60 define a line which intersects the direction of travel 61 at a 45 degree angle.

The winding station 2 includes a conventional yarn end receiving element having a suction tube 24 for applying a suction force through a suction intake mouth 25. The suction tube 24 is movable to move the suction intake mouth 25 along a circular arc 26. The yarn end receiving element is operable to receive a yarn end loosened from a yarn package at the unwinding location to convey the yarn end to a conventional splicing mechanism (not shown) for splicing with a yarn end of a yarn wound on a cross wound package (not shown) at the unwinding device 2 or for delivery to a yarn delivery component such as the splicing device 22 of the unwinding machine 2.

The yarn end loosening apparatus 31 operates as follows to loosen a yarn end of a yarn package supported on one of the tube support members 38,39,40 and to support the yarn package during subsequent unwinding of the yarn from the yarn package at the winding station 2. The tube support members 38,39,40, each supporting a tube having a yarn package built thereon such as, for example, the yarn packages 36,37 supported on the tube support members 39,40, respectively, are delivered by the delivery assembly 68 to the preliminary location for feeding to the unwinding device 2. In conventional manner, the tube support members 38,39,40 are loaded onto the endless belt of the cross-transport assembly 32 such that they are transported in the direction of travel 61 while arranged serially with respect to each other, as seen in FIG. 1.

As the tube support members 38,39,40 travel in the direction of travel 61 toward the unwinding location, the second chamber portion 50*b* is initially disposed in a clearance position in which it is sufficiently spaced from the cross path to permit the tube support members to be moved therepast by the crosstransport assembly 32. The second chamber portion 50*b* is disposed in its clearance position by appropriate control of the second movement means 65 by the central control unit 73. Specifically, the central control unit 73 controls the second movement means 65 to cause it to be charged with a conventional hydraulic fluid from a conventional hydraulic fluid source (not shown). The charging of the second movement means 65 with hydraulic fluid causes the connector 63 to be retracted into the second movement means 65, thereby displacing the second chamber portion 50*b* laterally toward the same side of the cross-transport assembly 32 as the side on which the second support post 67 is disposed to an extent sufficient for the cylindrical body portion and the enlarged foot portion 50*b'* to be clear of the cross path.

The first chamber portion 50*a* is initially disposed in the chamber forming position whereby it intersects the cross path. As seen in FIG. 6, the semi-cylindrical body portion and the enlarged foot portion 50*a'* of the first chamber portion 50*a* face in the direction opposite to the direction of travel 61.

The cross-transport assembly 32 eventually moves the forward- most tube support member 38, as viewed in the direction of travel 61, past the second chamber portion 50*b*, which is disposed in its clearance position, and, further, into contact with the inner surface of the first chamber portion 50*a*. The base cylindrical plate 42 of the tube support member 38 contacts the enlarged foot portion 50*a'*, whereby further travel of the tube support member 38 in the direction of travel 61 is prevented. The tube support member 39, which is the next tube support member following the tube support member 38, has its base cylindrical plate 42 in contact with the base cylindrical plate 42 of the preceding tube support member 38 due to the continuous action of the endless belt of the cross-transport assembly 32.

The central control unit 73 then controls the second movement means 65 to extend the connector 63 to thereby effect movement of the second chamber portion 50*b* from its clearance position to the chamber forming position in which the second chamber portion 50*b* and the first chamber portion mate along the first engagement line 59 and second engagement line 60 with the yarn package supported on the tube support member 38 supported in upright disposition therebetween. The enlarged foot portion 50*b'* of the second chamber portion 50*b* displaces the tube support members 39 and 40 slightly in the direction opposite to the direction of travel 61 during the movement of the second chamber portion 50*b* from its clearance position to the chamber forming position. Accordingly, once the second chamber portion 50*b* is disposed in the chamber forming position, the enlarged foot portion 50*b'* extends between the respective cylindrical base plates 42 of the tube support member 38 and the tube support member 39 to thereby space the two tube support members from one another.

The gas guide chamber 50 formed by the first chamber portion 50*a* and the second chamber portion 50*b* provides a substantially sealed enclosure along the extent of the yarn package supported on the tube support member 38. Accordingly, once the second portion chamber 50*b* mates with the first chamber portion 50*a* to form the gas guide chamber 50, the central control unit 73 can control the regulating valve 57 to supply compressed gas to the jet nozzles 51,52 and 53. As seen in FIG. 1, the jet nozzles are oriented to direct jet streams of gas in inclined tangential directions with respect to the yarn package to loosen a yarn end of the yarn package.

The loosened yarn end is directed upwardly under the influence of a helical gas flow which occurs due to the orientation of the jet nozzles 51,52,53 and the cylindrical shape formed by the semi-cylindrical body portions of the first chamber portion 50*a* and the second chamber portion 50*b*. The helical flow of gas eventually lifts the loosened yarn end toward the top of the gas guide chamber 50 for engagement of the yarn end by the suction mouth of the suction device 24. Once the suction device 24 has grasped the loosened yarn end, the suction device 24 signals the central control unit 73 in conventional manner and the central control unit 73 controls the regulating valve 57 to cease the flow of compressed gas from the compressed gas source 58 to the jet nozzles 51,52,53. The central control unit 73 also controls the suction device 24 to swing the suction mouth 25 along the circular arc 26 to deliver the engaged yarn end to the splicing device for subsequent continued unwinding of the yarn from the yarn package disposed within the gas guide chamber 50.

Once the yarn on the yarn package supported on the tube support member 38 has been completely unwound, only an empty tube remains on the tube support member 38. In correspondence with the completion of the unwinding of the yarn package, the central control unit 73 controls the first movement means 64 to retract the connector 62 to thereby move the first chamber portion 50*a* from the chamber forming position to a clearance position in which the first chamber portion is cleared from the cross path sufficiently for the tube support member 38 to be conveyed therepast by the crosstransport assembly 32 toward the discharge location. Additionally, the central control unit 73 controls the second movement means 65 to retract the second chamber portion 50*b* from the chamber forming position to its respective clearing position.

Once the second chamber portion 50*b* reaches its respective clearance position, the next following tube support member 39 is moved by the action of the cross-transport assembly 32 in the direction of travel 61 into the unwinding location. In coordination with the movement of the tube support member 39 into the unwinding location, the central control unit 73 controls the first movement means 64 to move the first chamber portion 50*a* from its respective clearance position to a travel blocking position in which the enlarged foot portion 50*a'* sufficiently extends into the cross path at the unwinding location to prevent further travel of the tube support member 39 in the direction of travel 61.

The movement of the first chamber portion 50*a* from its respective clearance position to the travel blocking position is timed in coordination with the movement of the support member 38, which has just exited the unwinding location, such that the tube support member 38 has traveled sufficiently beyond the first chamber portion 50*a* to preclude the movement of the first chamber portion from its clearance position to the travel blocking position from hindering the movement of the tube support member 38 toward the discharge location. Depending upon the operating circumstances, the travel blocking position of the first chamber portion 50*a* may be substantially coincidental with its chamber forming position. In other operating circumstances, the travel blocking position may entail the positioning of the enlarged foot portion 50*a'* only slightly into the cross path but to a sufficient extent to prevent further travel of the next following tube support member 39. Thereafter, the first chamber portion 50*a* is moved to the chamber forming position.

Once the next following tube support member 39 is positioned at the unwinding location in contact with the first chamber portion 50*a*, the central control unit 73 controls the second movement means 65 to move the second chamber portion 50*b* from its respective clearance position to the chamber forming position. During this movement, the second chamber portion 50*b* contacts the tube support member 40, which is now the next following tube support member with respect to the tube support member 39 at the unwinding location, and displaces the tube support member 40 in a direction opposite to the direction of travel 61 as the second chamber portion moves into the chamber forming position. The enlarged foot portion 50*b'* is now interposed between the respective cylindrical base plates 42 of the tube support members 39,40. In correspondence with the movement of the second chamber portion 50*b* into the chamber forming position, the central control unit 73 controls the regulating valve 57 to supply compressed gas to the jet nozzles 51,52,53 to perform a yarn end loosening operation on the yarn package supported by the tube support member 39.

In FIG. 6, another form of the means for moving the first chamber portion 50*a* and the second chamber portion 50*b* between their respective clearance, travel blocking and chamber forming positions is illustrated. The yarn end loosening apparatus 31 illustrated in FIG. 6 is identically configured to the embodiment of the apparatus illustrated in FIG. 1 except that the first movement means 64, the connector 62, the second movement means 65, the connector 63, the first support post 66 and the second support post 67 are deleted. The yarn end loosening device 31 includes instead a first connector arm 181 fixedly connected to the first chamber portion 50*a* and a second connector arm 182 fixedly connected to the second chamber portion 50*b*, as seen in FIG. 6 The first connector arm 181 is fixedly connected to a first cylindrical tube member 190 and the second connector arm 182 is fixedly connected to a second cylindrical tube member 191. The first cylindrical tube member 190 is rotatably supported by a bearing assembly 186 which is fixedly connected to the support frame 5, as shown in FIG. 6. The second cylindrical tube member 191 is rotatably mounted to the support frame 5 by a bearing assembly 188. A first vertical shaft 179 is coaxially mounted in the first cylindrical tube member 190 and a second vertical shaft 180 is coaxially mounted in the second cylindrical tube member 191 A first link member 193 is fixedly connected to the first cylindrical tube member 190 and a second link member 194 is fixedly connected to the second cylindrical tube member 191, as seen in FIG. 6. As seen in FIG. 6, the first link member 193 is pivotally connected to the free end of a first rod 197. The first rod 197 is interconnected to a first piston 64' for selectively retraction and extension of the first rod 197 relative to the first piston 64'.

The second link member 194 is pivotally connected to one end of a connector 198 and the other end of the connector 198 is pivotally connected to one end of a rocker lever 195 that is pivotally connected by a pivot 200 to the support frame 5. The other end of the rocker lever 195 is pivotally connected to the free end of a second rod 199. The second rod 199 is interconnected to a second piston 65' which is operable to selectively retract and extend the second rod 199. The first piston 64' and the second piston 65' are fixedly connected to the support frame 5 by appropriate conventional securement means. Additionally, the first piston 64' and the second piston 65' are operatively connected conventionally to the central control unit 73.

In operation, the first piston 64' and the second piston 65' are selectively controlled by the central control unit 73 to effect movement of the first chamber portion 50*a* and the second chamber portion 50*b* between their respective clearance, travel blocking and chamber forming positions. Specifically, to position the first chamber portion 50*a* in its chamber forming position, as shown in FIG. 6, the first piston 64' extends the first rod 197. The extension of the first rod 197 effects pivoting of the first link member 193 about the axis of the first vertical shaft 179. Since the first link member 193 is fixedly connected to the first cylindrical tube member 190, the first cylindrical tube member 190 rotates about the axis of the first vertical shaft 179 in correspondence with the rotation of the first link member 193 and thereby effects rotation of the first connector arm 181 about the axis of the first vertical shaft 179 in a clockwise direction, as viewed in FIG. 6.

The clockwise rotation of the first connector arm 181 positions the first chamber portion 50*a* in its chamber forming position. In correspondence with the positioning of the first chamber portion 50*a* in its chamber forming position, the next one of the tube support members 38,39 or 40 to be fed to the unwinding location is advanced under the action of the cross-transport assembly 32 into contact with the inner surface of the first chamber portion 50*a*. The central control unit 73 then controls the second piston 65' to extend the second rod 199. The extension of the second rod 199 effects pivoting of the rocker lever 195 about the pivot 200 and the pivoting of the pivot 195 causes, via the connector 198, clockwise pivoting of the second link member 194, as viewed in FIG. 6. The clockwise pivoting of the second link member 194 effects rotation of the second cylindrical tube member 191 in a clockwise direction about the axis of the second shaft 180 and the pivoting of the second cylindrical tube member 191 effects movement of the second chamber portion 50*b* from its respective clearance position 205 to its chamber forming position in which it mates with the first chamber portion 50*a* along the first interface line 59 and the second interface line 60. The respective yarn package which is thus enclosed within the gas guide chamber 50 then undergoes a yarn end loosening operation and a subsequent unwinding operation at the unwinding location.

Once the yarn package has been completely unwound at the unwinding location, the central control unit 73 controls the first piston 74' to retract the first rod 197 to thereby effect, via the first cylindrical tube member 190 and the first connector arm 181, movement of the first chamber portion 50*a* from its chamber forming position to its respective clearance position 206. The respective tube support member 38,39 or 40, which now supports an empty tube at the unwinding location, is then transported by the action of the cross-transport assembly 32 from the unwinding location to the discharge location.

Due to the orientation of the first interface line 59 and the second interface line 60 along a line forming a 45 degree angle with respect to the direction of travel 61, the vertical end portion of the first chamber portion 50*a* which mates with the second chamber portion 50*b* along the first interface line 59 may overlap the cross path to a slight extent, thereby preventing an oncoming tube member from being advanced into the unwinding location. In this regard, the central control unit 73 can be programmed to control the first piston 64' to move the first chamber portion 50*a* from its chamber forming position along a relatively small extent of its travel path 204 toward its respective clearance position 206 by an amount sufficient to move the vertical end portion which would otherwise interfere with the travel of the tube support member, clear of the cross path. Likewise, the vertical end portion of the second chamber portion 50*b* which mates with the first chamber portion 50*a* along the second interface line 60 may extend into the cross path so as to interfere with the movement of a tube support member from the unwinding location toward the discharge location. In this regard, the central control unit 73 can be programmed to control the second piston 65' to effect movement of the second chamber portion 50*b* along its travel path 201,202 toward its clearance position 205 by an amount sufficient to clear the respective vertical end portion of the second chamber portion 50*b* from the cross path.

Following this slight movement of the second chamber portion 50*b*, the respective tube support member can then be transported in an unobstructed manner by the cross-transport assembly 32 from the unwinding location toward the discharge location. At an appropriate time, the central control unit 73 can then fully move the second chamber portion 50*b* to its clearance position 205 to permit the travel of the next following support member into the unwinding location.

Figure 4:
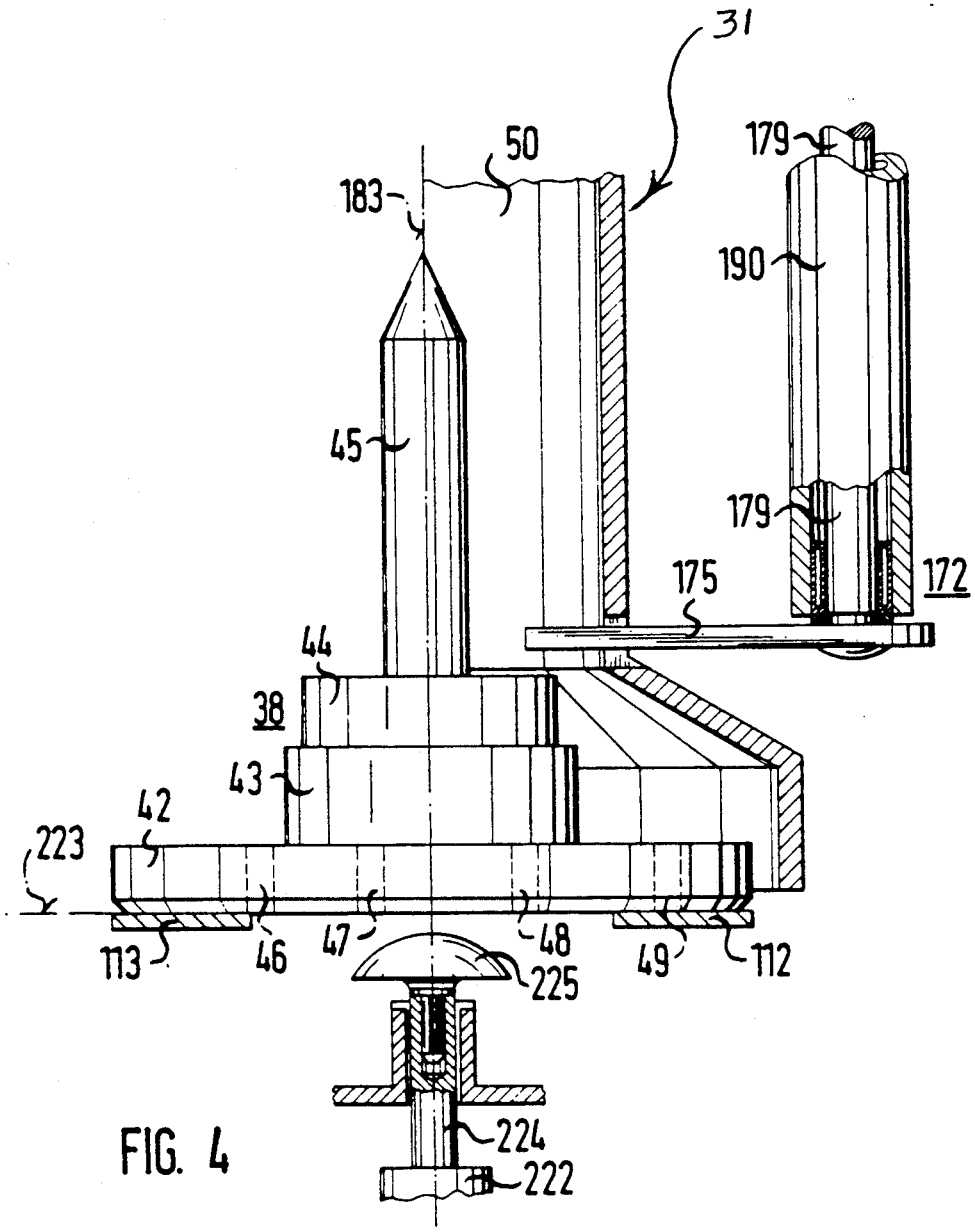
FIG. 4 is a vertical sectional view of another type of the yarn package support apparatus shown in FIG. 1 and a partial sectional view of a portion of another embodiment of the tube stabilizing apparatus of the present invention.

The yarn package transport assembly 3 includes a conventional endless belt assembly 70 for supporting and transporting a plurality of tube support members 38, 39 and 40 to the unwinding location. As seen in FIG. 4, the endless belt assembly 70 includes a pair of parallel endless belts 112,113 spaced laterally from one another with respect to the direction of travel of the belts.

Figure 2:
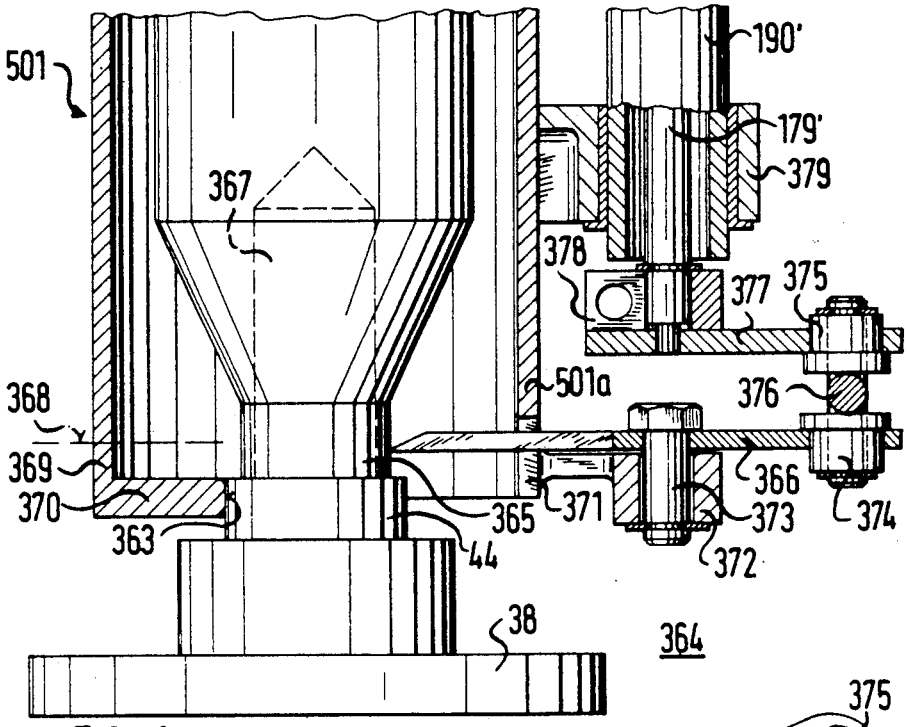
FIG. 2 is a vertical sectional view of a portion of one type of the yarn package support apparatus shown in FIG. 1 and one embodiment of the tube stabilizing apparatus of the present invention.
Figure 3:
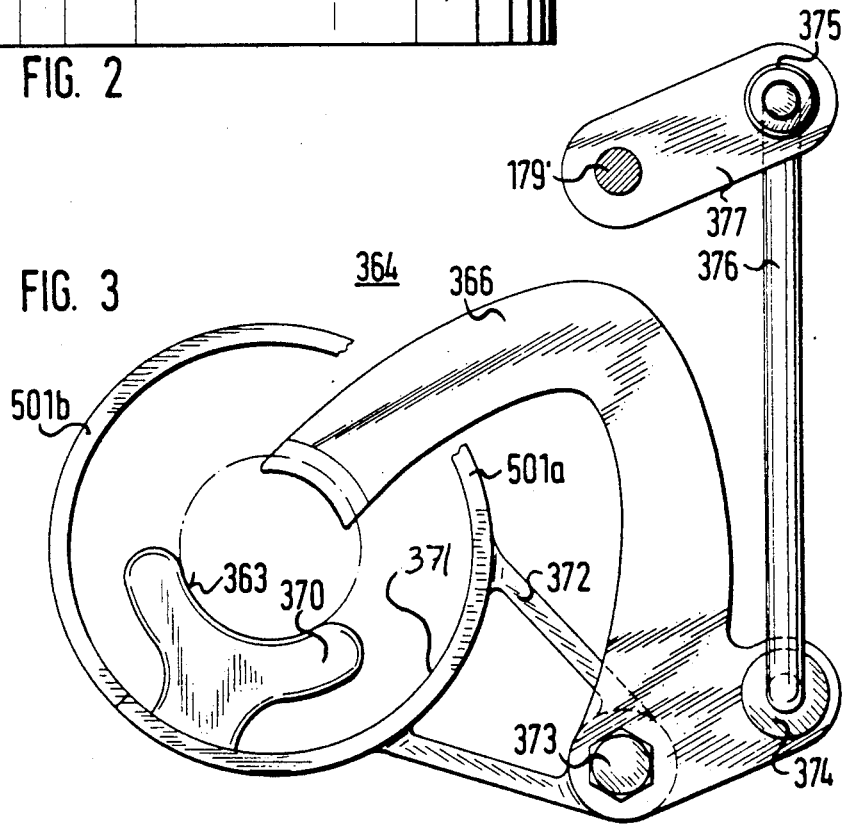
FIG. 3 is a plan view of the yarn package support apparatus and the embodiment of the tube stabilizing apparatus shown in FIG. 2.

In FIGS. 2 and 3, one embodiment of the tube stabilizing apparatus of the present invention is illustrated. Additionally, another embodiment of the tube stabilizing apparatus is illustrated in FIGS. 4, 5, 7 and 8.

Figure 5:
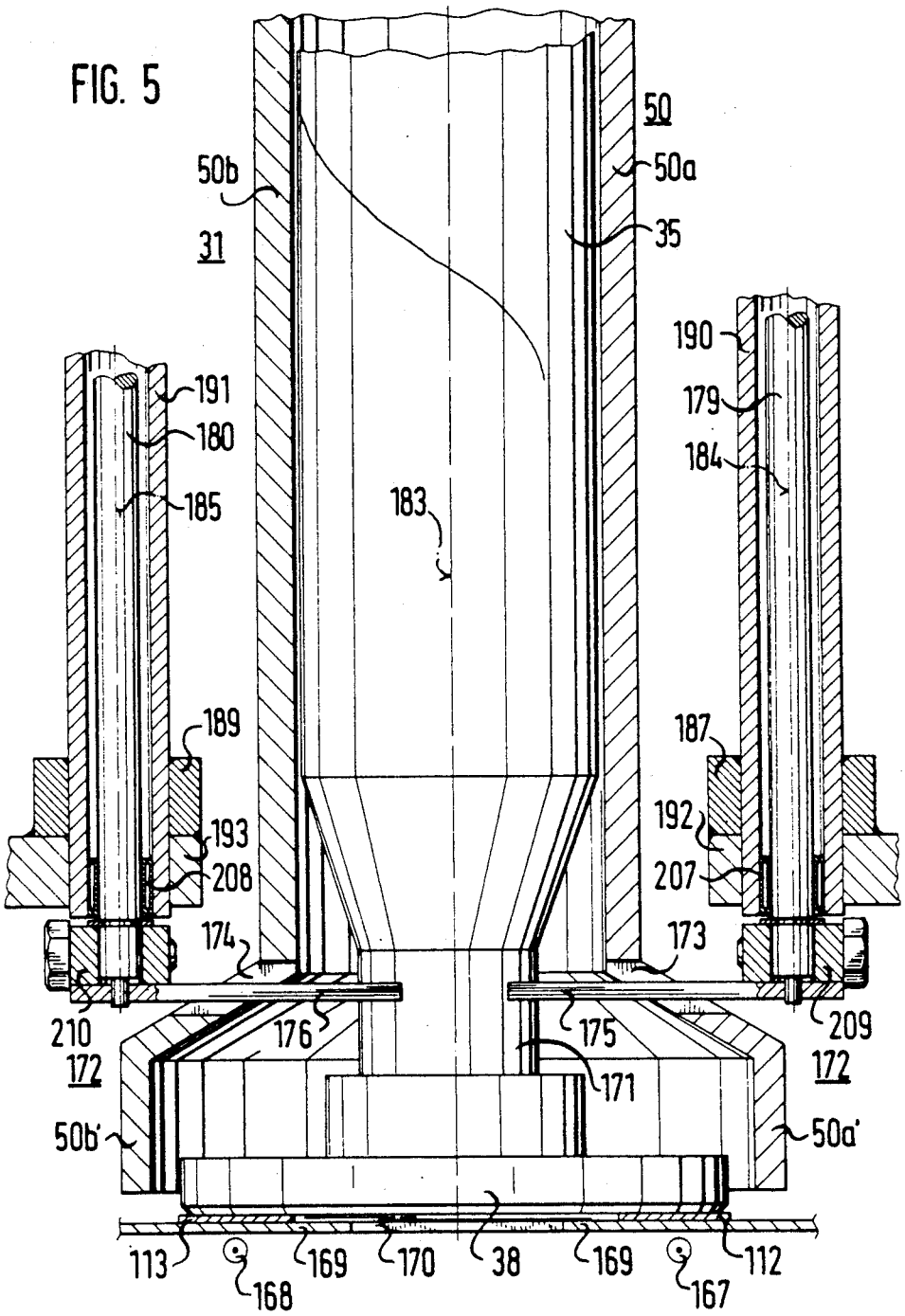
FIG. 5 is a vertical sectional view of the another embodiment of the tube stabilizing apparatus shown in FIG. 4, showing another engagement arm of the tube stabilizing apparatus.

As seen in FIGS. 4, 5, 7 and 8, the tube stabilizing apparatus 172 includes a first arm means 175 and a second arm means 176. The first arm means 175 is fixedly connected to the lower end of the shaft 179 by a conventional securement means such as, for example, a conventional rivet means as shown in FIG. 4 or by an attachment means 209, as illustrated in FIG. 5. One end portion of the second arm means 176 is fixedly connected to the bottom portion of the shaft 180 by appropriate conventional securement means such as, for example, rivet means, or an attachment member 210 as shown in FIG. 5. Accordingly, the first arm means 175 and the second arm means 176 pivot about the axis of the shafts 179, 180, respectively, during axial movement of these shafts.

Figure 7:
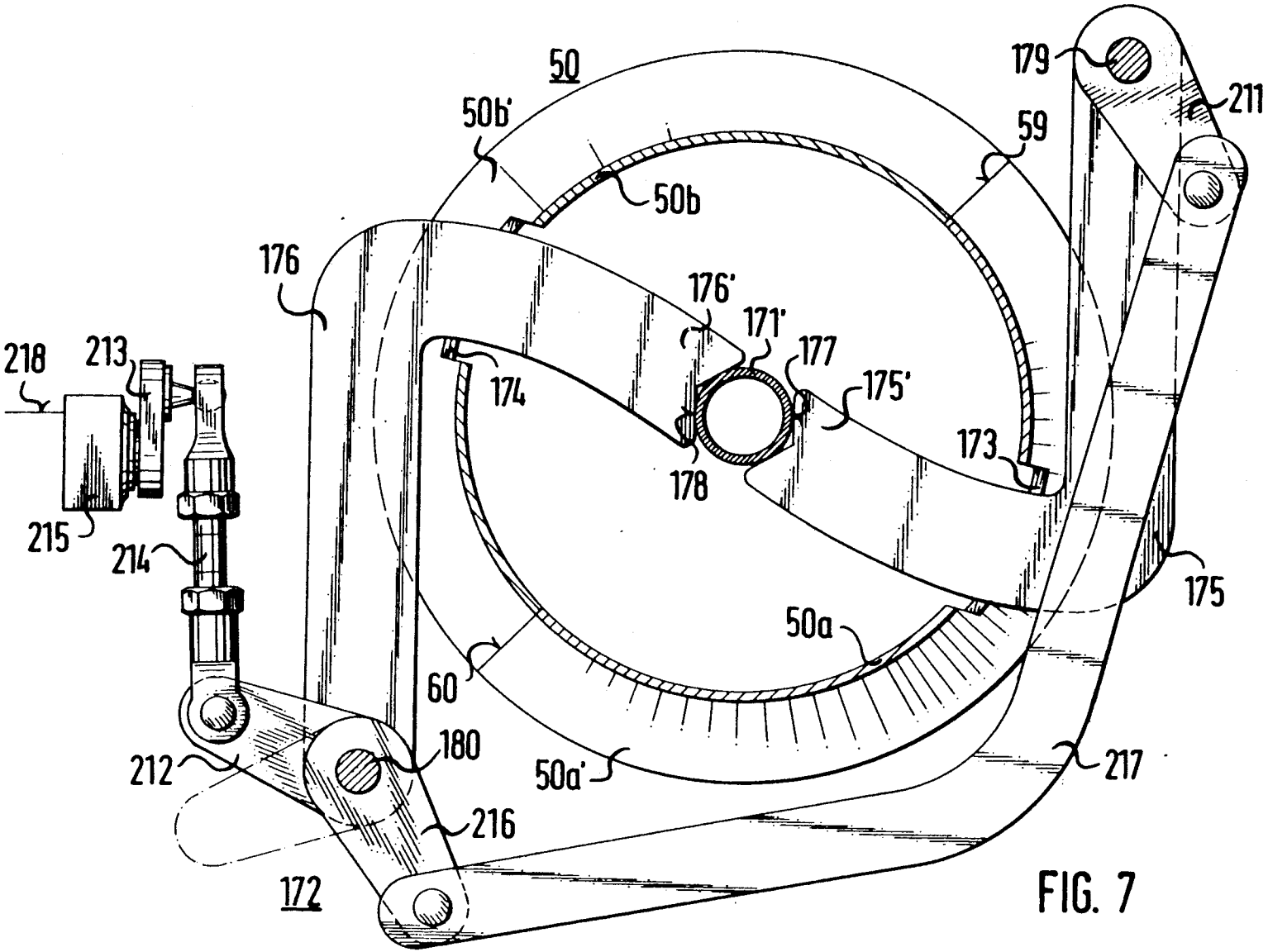
FIG. 7 is a top plan view of the another embodiment of the tube stabilizing apparatus shown in FIG. 5.
Figure 8:
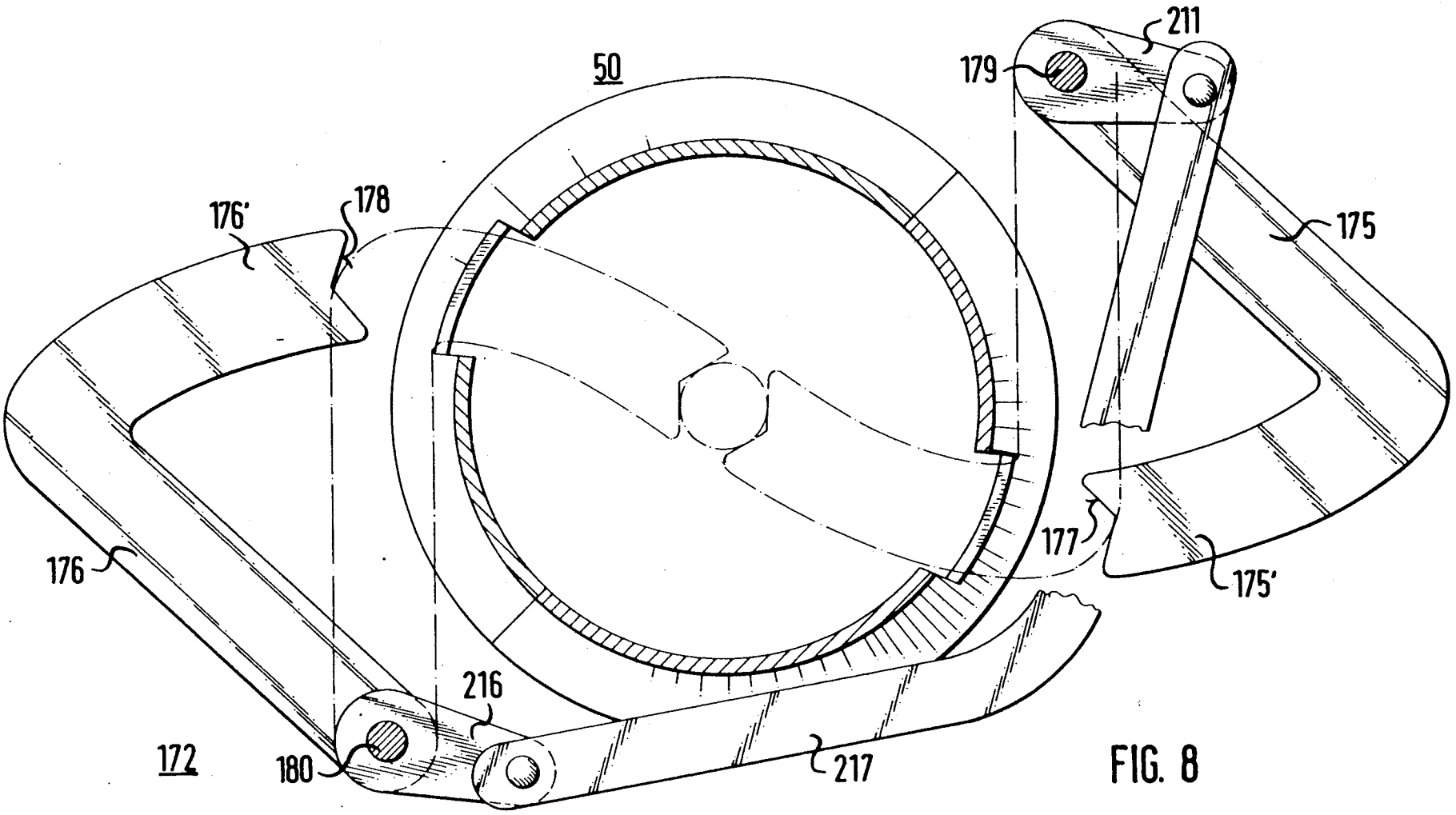
FIG. 8 is a top plan view of the another embodiment of the tube stabilizing apparatus shown in FIG. 7, showing the apparatus in its disengaged disposition.

As seen in FIGS. 7 and 8, the first arm means 175 includes an arcuate portion 175' forming the free end thereof. The arcuate portion 175' is formed along an arcuate center line having a radius of curvature centered on the axis of the shaft 179. The free end of the arcuate portion 175' includes a concave surface 177. The second arms means 176 includes an arcuate portion 176' having an arcuate center line whose radius of curvature is centered on the axis of the shaft 180. The arcuate portion 176' has a free end that includes a concave surface 178 facing the concave surface 177 of the first arms means 175.

As seen in FIG. 5, the yarn package 35 supported on the tube support member 38 comprises yarn built onto a tube 171 The yarn built on the tube 171 includes a bottom tapered portion which defines the bottom edge of the yarn winding. As seen in FIG. 5, the bottom edge defined by the bottom tapering portion of the yarn winding is spaced from the bottom end of the tube 171 Accordingly, a bottom portion 171' of the tube 171 extending from the bottom edge of the yarn winding to the bottom of the tube is exposed (it has no yarn windings thereon). As seen in FIGS. 5 and 7, the tube stabilizing apparatus 172 is operable to engage the bottom exposed portion 171' of the tube 171 to stabilize the tube during unwinding of the yarn built thereon. To this end, the concave surface 177 of the first arm means 175 and the concave surface 178 of the second arm means 176 are each compatibly configured with respect to the circumferential dimensions of the bottom tube portion 171' to receive an arcuate segment of the bottom tube portion therein during engagement of the tube by the tube stabilizing apparatus 172.

The first arm means 175 and the second arm means 176 are pivotable about the axis of the shaft 179, 180, respectively, between a disengaged position, as illustrated in FIG. 8, in which the arms are out of engagement with the tube 171 and an engaged position, illustrated in FIG. 7, in which the contoured surfaces 177, 178 engage the bottom tube portion 171' from generally opposed directions to stabilize the tube 171. To accommodate movement of the first arm means 175 and the second arms means 176, the yarn package support member 31 permits access of the arm means into, and out of, the interior of the gas guide chamber 50. Specifically, as seen in FIGS. 5 and 7, the first chamber portion 50*a* includes an arcuate opening 173 and the second chamber portion 50*b* includes an arcuate opening 174.

The arcuate openings 173, 174 are disposed at the same vertical height as the horizontal plane through which the first arm means 175 and the second arm means 176 move as they move between the engaged and disengaged position of the tube stabilizing apparatus 172, following their radii curvature. Additionally, the annular openings 173 and 174, as seen in FIG. 7, extend horizontally along arcs slightly greater than the extent of the arcuate portions 175' and 176' of the first and second arm means 175 and 176. The radial extents of the arcuate portions 175' and 176' are uniform so that relatively narrow openings 173 and 174 will accommodate movement of the arcuate portions 175' and 176'.

The first arm means 175 and the second arm means 176 are interconnected by a translating assembly which translates pivoting of one of the arm means about its respective axis into corresponding pivoting of the other arm means about its respective axis. The translating assembly includes a first drive arm 211 connected to the shaft 179, a second drive arm 216 connected to the shaft 180 adjacent the top of the shaft, and a link member 217 pivotally connected at one end by a conventional pivot member to the free end of the first drive arm 211 and pivotally connected at its other end to the free end of the second drive arm 216 by a conventional pivot member.

As seen in FIG. 7, the tube stabilizing apparatus 172 additionally includes a drive assembly operatively connected by an electrical line 218 to the central control unit 73 for driving the first arm means 175 and the second arm means 176 between their respective disengaged and engaged positions. The drive assembly includes a conventional motor 215 having a rotating shaft, an eccentric drive lever 213 fixedly connected at one end to the rotating shaft of the drive motor 215, a driven member 214 and a link member 212. The link member 212 is fixedly connected to the shaft 180 adjacent the tope of the shaft. The other end of the link member 212 is pivotally connected by a conventional pivot member to the free end of the driven member 214. The other end of the driven member 214 includes a cylindrical race for receiving a spherical portion therein. The eccentric drive arm 213 includes a projection adjacent its free end and the free end of the projection is formed with a spherical portion compatibly configured with the cylindrical race of the driven member 214 to be received therein. As seen in FIG. 7, the link member 212 is disposed in the position indicated by the phantom lines when the tube stabilizing apparatus 172 is in its disengaged position.

In operation, the drive motor 215 is controlled by the central control unit 73 to selectively move the tube stabilizing apparatus 172 between its engaged and disengaged positions. As seen in FIG. 8, the tube stabilizing apparatus 172 is initially in its disengaged position during the yarn end engagement operation in which the first chamber portion 50*a* and the second chamber portion 50*b* are disposed in their chamber forming position to enclose a yarn package such as, for example, the yarn package 35. During the yarn end engaging operation, the yarn package 35 is subjected to yarn end loosening action by the helically flowing streams of gas introduced through the jet nozzles 51, 52 and 53 into the gas guide chamber 50. Additionally, the yarn package, including the tube support member 38, may be subjected to wobbling or tilting action by an assembly such as 222,224 and 225 to facilitate the loosening of a yarn end of the yarn package. Once the yarn end has been engaged by the suction mount 25 of the suction device 24 and delivered further to other components of the winding machine 2 for winding of the yarn onto a cross-wound package, the central control unit 73 operates the tube stabilizing apparatus 172 to stabilize the tube 171 during the subsequent normal unwinding of the yarn from the yarn package 35.

The tube support member conveying apparatus additionally includes a tilt assembly for facilitating the loosening of a yarn end of a yarn package at an unwinding location. As seen in FIG. 4, the tilt assembly includes a conventional pneumatic cylinder and piston assembly having a piston rod 224 movably received in a cylinder 222, the assembly being operable to extend and retract its piston vertically, and a non-planar convex contact member 225 in the form of an inverted spherical segment fixedly mounted to the free end of the piston rod 224. The cylinder 222 of the pneumatic cylinder and piston assembly is fixedly connected to the support frame 5 by conventional securement means (not shown). The axis of the piston rod 224 is aligned with the axis 183 of the gas guide chamber 50 at the unwinding location.

The tilt assembly is operatively connected to the central control unit 73 and is operable to selectively extend the contact member 225 through the opening located between the endless belts 112, 113 into contact with a respective tube support member at the unwinding location to effect movement of the tube on the respective tube support member between its initial supported position in which the tube axis is perpendicular to the support plane 223 and an offset position in which the tube axis is at an acute angle with respect to the support plane 223. Specifically, the tilt assembly is operable to selectively vertically extend the contact member 225 from a position vertically below the support plane 223 at the unwinding location to a position in which the contact member 225 is vertically extended into engagement with the bottom surface of the tube support member to thereby lift and tilt the tube support member.

As the center of the tube support member is raised, a portion of the base cylindrical plate 42 of the tube support member in contact with one of the endless belts 112.113 remains in contact with the respective endless belt while the other portion of the base cylindrical plate 42 previously in contact with the other of the endless belts 112,113 is raised from the other endless belt. This movement effects tilting of the axis of the upright component 45 relative to the axis 183 of the gas guide chamber 50 and, accordingly, tilting of the yarn package supported on the upright component 45. Thus, a yarn package such as, for example, the yarn package 35, which is supported on the tube within the unwinding location, is moved into leaning disposition with the inner surface of the gas guide chamber 50.

Since the yarn package is in leaning disposition against the inner surface of the gas guide chamber 500, the yarn package is be subjected to relative movement along the inner surface upon the introduction of streams of gas thereagainst such as, for example, upon the introduction of streams of gas through the jet nozzles 51,52 and 53. The movement of the yarn package relatively along the inner surface of the gas guide chamber 50 facilitates the loosening of the yarn end. At the completion of the unwinding of the yarn end, the yarn end has traveled upwardly beyond the gas guide chamber 50 to be engaged by the suction tube 24, whereupon the central control unit 73 controls the pneumatic cylinder and piston rod assembly to retract its piston rod to lower the contact member 225 to its non-engaged position below the level of the plane 223.

Specifically, the central control unit 73 controls the drive motor 215 to move the link member 212 from the phantom line position shown in FIG. 7 to the solid line position shown in FIG. 7 to thereby effect movement of the tube stabilizing apparatus from its disengaged position to its engaged position. Accordingly, the central control unit 73 controls the drive motor 215 to rotate the eccentric arm member 213. The rotation of the eccentric arm member 213 causes the spherical portion of the projection of the eccentric arm member to move the driven member 214. As can be understood, the spherical portion of the projection of the eccentric arm member 213 moves within the cylindrical race of the driven member 214 during this movement. The movement of the driven member 214 effects pivoting of the link member 212 about the shaft 180.

Since the link member 212 is fixedly connected to the second arm means 176, the movement of the link member 212 effects pivoting of the second arms means 176 about the axis of the shaft 180 to move the arcuate portion 176' through the arcuate opening 174 into engagement with the bottom tube portion 171'. The pivoting movement of the second arms means 176 is translated via the translating assembly to the first arm means 175 so that the first arm means 175 pivots about the axis of the shaft 179 in correspondence with the pivoting movement of the second arm means 176. Specifically, the pivoting of the second arm means 176 causes pivoting of the second drive arm 216 about the axis of the shaft 180 which, in turn, effects pivoting of the first drive arm 211 about the axis of the shaft 176 due to the interconnection of the second drive arm 216 by the link member 217 with the first drive arm 211. Upon the completion of their respective pivoting movements, the first arm 175 and the second arm 176 compressively engage the bottom tube portion 171' therebetween to stabilize the tube during the unwinding of yarn therefrom.

In coordination with the completion of the unwinding of the yarn from the yarn package 35, the central control unit 73 operates the yarn package support apparatus 31 and the tube stabilizing apparatus 172 to move to their respective positions for releasing the tube support member 38, with the empty tube 171 thereon, for further transport from the unwinding location to the discharge location. In this regard, the central control unit 73 controls the tube stabilizing apparatus 172 to move from its engaged position to its disengaged position prior to movement of the first chamber portion 50*a* and the second chamber portion 50*b*. To move the tube stabilizing apparatus 172 from its engaged position to its disengaged position, the central control unit 73 controls the drive motor 215 to rotate the eccentric arm member 213 to thereby drive the link member 212 via the driven arm 214, from the solid line position to the phantom line position shown in FIG. 7. The movement of the link member 212 effects pivoting of the second arm means 176 and, via the translation assembly, pivoting of the first arm means 175. The pivoting of the first arm means 175 and the second arm means 176 effects retraction of the arcuate portions 175', 176' through the annular openings 173, 174, respectively.

In correspondence with the disposition of the tube stabilizing apparatus 172 in its disengaged position, the central control unit 73 controls the yarn package support apparatus 31 to move the first chamber portion 50*a* and the second chamber portion 50*b* to their respective positions for releasing the tube support member 38 with the empty tube 171 supported thereon and for permitting the next following tube support member with a full package to move into the unwinding location. In this regard, the movements of the first chamber portion 50*a* and the second chamber portion 50*b*, which involve pivoting movement about the shafts 179, 180, respectively, occurs without the need to displace the first arm means 175 or the second arm means 176 from their disengaged positions. Since the arcuate portion 175' lies on the same radius of curvature as the annular opening 173 of the first chamber portion 50*a*, the pivoting of the first chamber portion 50*a* about the shaft 179 causes the annular opening 173 to move along the same arcuate path as the arcuate portion 175. As a result, the annular opening 173 moves relatively along the arcuate portion 175 during the pivoting movement of the first chamber portion 50*a*. Likewise, the disposition of the arcuate portion 176' along the same radius of curvature as the annular opening 174 permits the annular opening to move relatively along the arcuate portion 176' during pivoting movement of the second chamber portion 50*b*.

As seen in FIGS. 2 and 3, another embodiment of the tube stabilizing apparatus of the present invention is illustrated and is generally designated as 364. As seen in FIG. 2, the tube stabilizing apparatus 364 is configured to operate in cooperation with one form of the yarn package support member 31 which has a gas guide chamber 501 formed by a first chamber portion 501*a* and a second chamber portion 501*b*. The first chamber portion 501*a* includes a downwardly extending portion 371. A bracket 372 extends radially outwardly from the first chamber portion 501*a*. A pivot arm 366 is pivotally mounted to the bracket 372 by a conventional pivot pin 373. The pivot arm 366 is pivotally connected to one end of a link arm 376 by a conventional pivot assembly 374. The other end of the link arm 376 is pivotally connected by a conventional pivot connection 375 to one end of a drive arm 377. The drive arm 377 is fixedly connected to the bottom of the shaft 179' by a conventional clamp assembly 378.

The second chamber portion 501*b* includes a downwardly extending flange member 369 having a radially inwardly projecting stop member 370. The stop member 370 includes a concave surface 376 facing radially inwardly with respect to the gas guide chamber 501.

As seen in FIG. 2, the pivot arm 366 pivots about the pivot pin 373 in a horizontal plane 368 to selectively press the bottom tube portion 365 of a tube against the upright component 367 of the tube support member while the diametrically opposed concave surface 363 of the stop member 370 simultaneously presses against the intermediate cylindrical plate 44 of the tube support member 38 in a direction generally opposed to the direction of the force applied by the pivot arm 366. Accordingly, the tube supported on the tube support member 38 is stabilized during the unwinding of yarn therefrom. In FIG. 6, an alternative means for driving the tube stabilizing device between its engaged and disengaged positions is illustrated. A lever arm 264 is fixedly connected, at one end, to the top of the shaft 179 and is pivotally connected, via a conventional pivot connection, at its other end to the rod of a conventional pneumatic cylinder and piston rod assembly 215'. The assembly 215' is connected via an electrical line 218 to the central control unit 73. The alternative movement means replaces the drive assembly illustrated in FIG. 7. In operation, the central control unit 73 controls the cylinder and piston rod assembly 215' to selectively extend or retract its piston rod to effect axial rotation of the shaft 179. The axial rotation of the shaft 179 produces movement of the first arm means 175 and (via the link member 217) the second arm means 176 between their respective disengaged and engaged positions.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile machine of the type having a plurality of independently movable tube support members for individually supporting tubes in generally upright dispositions, an unwinding device for unwinding, at an unwinding location, packages of textile material such as yarn or the like which is wound on tubes supported on the tube support members, a delivery assembly for delivering the tube support members to a preliminary location for feeding to the unwinding device, a discharge assembly for transporting tube support members from a discharge location to a further handling location, a cross-transport assembly for transporting the tube support members along a cross path extending from the preliminary location through the unwinding location to the discharge location and a yarn end loosening apparatus at the unwinding location having a pair of independently movable chamber portions, the chamber portions being pivotally mounted by a pivot member adjacent the cross path, and means for pivoting each chamber portion between a clearance position in which the chamber portion is clear of the cross path for travel of a tube support member therepast and a chamber forming position in which the chamber portions are disposed in contact with one another to form a gas guide chamber for encircling a yarn package at the unwinding location with a lateral opening formed in the gas guide chamber, a tube stabilizing apparatus, comprising:

means for engaging the tube of a supported package during unwinding of textile material from the package to prevent movement of the package during unwinding, said tube engaging means including an arm member, a member opposing said arm member and means for selectively moving said arm member relative to the gas guide chamber through the lateral opening thereof into contact with the tube of a yarn package at the unwinding location to thereby apply a force against the tube in a lateral direction toward said opposing member with said opposing member engaging a selected one of the tube and the tube support member opposite said lateral direction for stabilizing the tube between said arm member and said opposed member to minimize lateral movement of the tube.

2. In a textile machine, a tube stabilizing apparatus according to claim 1 and characterized further in that said opposing member is fixedly mounted to one of the chamber portions and is located generally at the level of the tube support member, said opposing member engaging the tube support member when said one chamber portion is disposed in the chamber forming disposition.

3. In a textile machine, a tube stabilizing apparatus according to claim 1 and wherein the lateral opening of the gas guide chamber is open toward the bottom of the chamber and the bottom portion of the tube is free of yarn and characterized further in that said arm member is moved relatively through the lateral opening generally at the level of the bottom portion of the tube for engagement thereof.

4. In a textile machine, a tube stabilizing apparatus according to claim 1 and characterized further in that said tube engaging means includes means for controlling said tube engaging means to engage a tube supported at the unwinding location in correspondence with the completion of the loosening of a yarn end of the yarn package.

5. In a textile machine, a tube stabilizing apparatus according to claim 1 and characterized further in that said opposing member is a movable arm member.

6. In a textile machine, a tube stabilizing apparatus according to claim 5 and characterized further by means interconnecting said arm members for synchronous tube engaging movement.

7. In a textile machine of the type having a plurality of independently movable tube support members for individually supporting tubes in generally upright dispositions, an unwinding device for unwinding, at an unwinding location, packages of textile material such as yarn or the like which is wound on tubes supported on the tube support members, a delivery assembly for delivering the tube support members to a preliminary location for feeding to the unwinding device, a discharge assembly for transporting tube support members from a discharge location to a further handling location, and a cross-transport assembly for transporting the tube support members along a cross path extending from the preliminary location through the unwinding location to the discharge location, and a yarn end loosening apparatus at the unwinding location having a pair of independently movable chamber portions, said chamber portions being pivotally mounted by a pivot member adjacent the cross path and each having a lateral opening, and means for pivoting each chamber portion between a clearance position in which the chamber portion is clear of the cross path for travel of a tube support member therepast and a chamber forming position in which the chamber portions are disposed in contact with one another to form a gas guide chamber for encircling a yarn package at the unwinding location, a tube stabilizing apparatus comprising:

means for engaging the tube of a supported package during unwinding of textile material from the package to prevent movement of the package during unwinding, said tube engaging means including first and second arm members, each having an arcuate portion forming a free end, and means for moving said arm members relative to the gas guide chamber between an engaged position in which the free ends of said first and second arm members are disposed oppositely one another to compressively grip the tube therebetween, each arcuate portion and a respective one of the chamber portions pivoting about a common pivot point, and each said arcuate portion moving through the lateral opening of a respective one of the chamber portions during relative movement between the chamber portions.

* * * * *